United States Patent [19]

Christiany

[11] Patent Number: 4,796,665

[45] Date of Patent: Jan. 10, 1989

[54] MULTI-PURPOSE DRAINING VALVE

[75] Inventor: Charles Christiany, Fameck, France

[73] Assignee: Societe Lorraine de Laminage Continu - Sollac, Florange, France

[21] Appl. No.: 9,738

[22] Filed: Feb. 2, 1987

[30] Foreign Application Priority Data

Feb. 7, 1986 [FR] France ..... 86 01725

[51] Int. Cl.[4] ..... F16K 1/54; F16K 49/00

[52] U.S. Cl. ..... 137/614.13; 137/240; 137/340; 251/86; 251/211

[58] Field of Search ..... 137/240, 340, 614.13, 137/614.21; 251/211, 84, 86, 87

[56] References Cited

U.S. PATENT DOCUMENTS

| | | | |
|---|---|---|---|
| 1,835,020 | 12/1931 | De Forest | 251/211 |
| 2,111,858 | 3/1938 | Jensen | 251/211 X |
| 2,195,866 | 4/1940 | Clarick . | |
| 3,090,593 | 5/1963 | Pao | 251/87 |
| 3,220,184 | 11/1965 | Oprecht | 251/211 X |
| 4,162,795 | 7/1979 | Kavics | 251/900 X |
| 4,345,623 | 8/1982 | Krull et al. | 251/86 X |
| 4,505,292 | 3/1985 | Osterode | 251/211 X |

FOREIGN PATENT DOCUMENTS

| | | |
|---|---|---|
| 3102784 | 8/1982 | Fed. Rep. of Germany . |
| 917467 | 1/1947 | France . |
| 516758 | 1/1972 | Switzerland . |
| 436684 | 10/1935 | United Kingdom . |

*Primary Examiner*—A. Michael Chambers
*Assistant Examiner*—John C. Fox
*Attorney, Agent, or Firm*—Bacon & Thomas

[57] ABSTRACT

A valve body comprises a first sealing seat and a second seat opposite the first. The valve element is selectively controlled so that, in addition to the position in which a bearing surface thereof rests on the first seat to ensure tightness of the device and of the circuit on which it is mounted, the valve element can be placed in a median position between the two seats, so as to provide a maximum flowing section between the valve element and the valve body for draining the circuit. In intermediate positions, another bearing surface of the valve element works in cooperation with the second seat, the valve element being held in a position selected between the first median position and a resting position on the second seat, thus limiting the flowing section between the valve element and the second seat to control the discharge of the circuit.

12 Claims, 3 Drawing Sheets

8
5
6
4
7
11
15
21
3
22
23
2
1
12

MULTI-PURPOSE DRAINING VALVE

BACKGROUND OF THE INVENTION

The present invention relates to a valve device of the drain or regulated discharge valve type for gaseous fluid circuits.

Conventionally, different types of valves are used for gaseous fluid circuits which, depending on the models, have different functions. All those valves, however, have one characteristic in common which is to ensure, in one of their positions, the tightness of the circuit on which they are mounted, and in another position, the more or less regulated and automatic connection of said circuit with the ambient medium or with another circuit of different characteristics, and in particular of different pressure.

In fact, there are several types of valves which can be regrouped depending on the position of the shutter or valve element with respect to its seat, and also depending on the shutter direction of motion and path when said valve opens, and on the control means.

One first group of valves is of the type with inner bearing surface, in which the valve element is situated inside the circuit with respect to its seat, and opens by moving towards the inside of the circuit.

A second group is of the type with external bearing surface, in which the valve element is situated outside the circuit with respect to its seat, and opens by moving outwardly.

One major disadvantage of these valves is that the flow of gaseous fluid, when the valve opens, is principally limited by the size of the passage between the valve seat and the valve element, i.e. between the surfaces used for sealing when the valve is closed.

The result is a relatively rapid deterioration of said surfaces due to the very nature of the gaseous fluid, or its temperature, or the solid particles that it may contain or carry, or simply due to the flowing conditions which can cause turbulence problems.

There is another type of valve which is different in that the movement of the valve element is not rectilinear along the axis of the device, and in that the valve element is lifted by pivoting in such a way as to completely clear the fluid passage. This is an improvement in the case of a draining operation, but it does not solve the problem of the limitation of the fluid flow by the sealing surfaces during a regulated discharge operation, the control of the delivery being always achieved by adjustment of the sealing surfaces of the valve element and of the seat.

Moreover, and regardless of the type of valve used, it may be necessary to change periodically the sealing element or the joints used for sealing the valve element. In the prior art valves, this maintenance operation is difficult and often dangerous, since performed while the valve is open, hence a possibility of being in contact with the gases of the circuit in question.

SUMMARY OF THE INVENTION

The object of the valve device according to the invention is to reduce if not eliminate completely the aforesaid disadvantages and in turn to offer the advantages described in detail hereinafter.

A valve device according to the invention comprises a valve element, movable according to the axis of the device, inside a valve body provided with a sealing seat on which a surface of said valve element can rest in such a way as to tightly separate one zone situated downstream of the device from another zone situated upstream of the device ; said device further comprising means for controlling the valve, which means are designed to move said valve element and to hold it in a predetermined position.

According to the invention, said device further comprises a second seat situated opposite the sealing seat, and the valve element is selectively controlled by said control means so that, in addition to the position in which the bearing surface of said valve element rests on said sealing seat in order to seal the device and the circuit on which said device is mounted, the valve element can be placed in median position between the two seats in order to provide a maximum passage section between said valve element and its body for draining the circuit, and so that in intermediate positions, another bearing surface of said valve acts in cooperation with the second seat, said valve element being kept in a position selected between said median position and a position in which the valve element rests on its second seat, in order to limit the passage section between the valve element and the second seat and thus to regulate the discharge of the circuit.

In particular, the device may have a vertical axis and the sealing seat may be situated on the side of the device farthest from the circuit and it is then called upper seat. In this case, the second seat is situated on the side of the device closest to the circuit and is called lower seat. The valve element may also be controlled to rest on said lower seat, hence sealing said lower seat from the circuit.

In fact, the valve device according to the invention is multi-purpose, each position of the valve element between the two seats defining a special function:

(a) a sealing function, when the valve element rests on the upper seat, (b) a draining function, when said valve element is in median position between the upper and lower seats, (c) a regulated discharge function, when said valve element is held by control means at a controlled distance from the lower seat.

Said valve element also has a fourth position or so-called "safety" position when it rests on the lower seat.

The constitution of this valve element with two bearing surfaces is designed to separate the various functions which the valve device is required to fulfill. Indeed, the upper part of the valve element and the upper seat are solely intended to ensure tightness, when the valve element rests on the upper seat, and they stop being functionally useful when the valve is in draining or in regulated discharge position.

In this last regulated discharge position, in particular, the flowing section of the gaseous fluid is determined by the distance existing between the lower seat and the valve element.

Indeed, the valve element being situated between its median position which leaves a flowing section approximately identical at the level of the lower seat and at the level of the upper seat, and its resting position on the lower seat, the flowing section between the valve element and the upper seat is greater than the flowing section between the valve element and the lower seat.

In this last controlled delivery position, the flow of gaseous fluid is limited by the smallest flowing section, hence the flowing section between the valve element and the lower seat, and it is in that zone of pressure and fast flow that the phenomena of deterioration which are due, among other things, to abrasion or to temperature, will be more obvious, whereas the flow in the zone of the upper seat will be slower, and the bearing surfaces ensuring tightness will then be protected, which will lengthen their working life.

In the draining position, the valve element is in median position, approximately at equal distance from the lower and upper seats, so that the flowing section between the valve body and the valve element is maximum and the pressure loss minimum while the gases are flowing.

Finally, the safety position, of the valve, namely when said valve is resting on the lower seat, is not intended to give perfect tightness to the circuit, but mainly to allow maintenance interventions on the sealing surfaces of the upper seat and of the valve element, such as for example for changing seals, without the maintenance staff being affected by gas vapors from the circuit. To further improve the conditions during such maintenance operations, and in case of a slight gas leak persisting between the valve element and the lower seat, this can be stopped by creating a water joint at the level of the valve-seat junction.

BRIEF DESCRIPTION OF DRAWINGS

The invention will be more readily understood on reading the following description with reference to the accompanying drawings, in which.

3*a*: insulating position

3*b*: draining position

3*c*: regulated discharge position

3*d*: safety position.

DETAILED DESCRIPTION OF A PREFERRED EMBODIMENT

Figure 1:
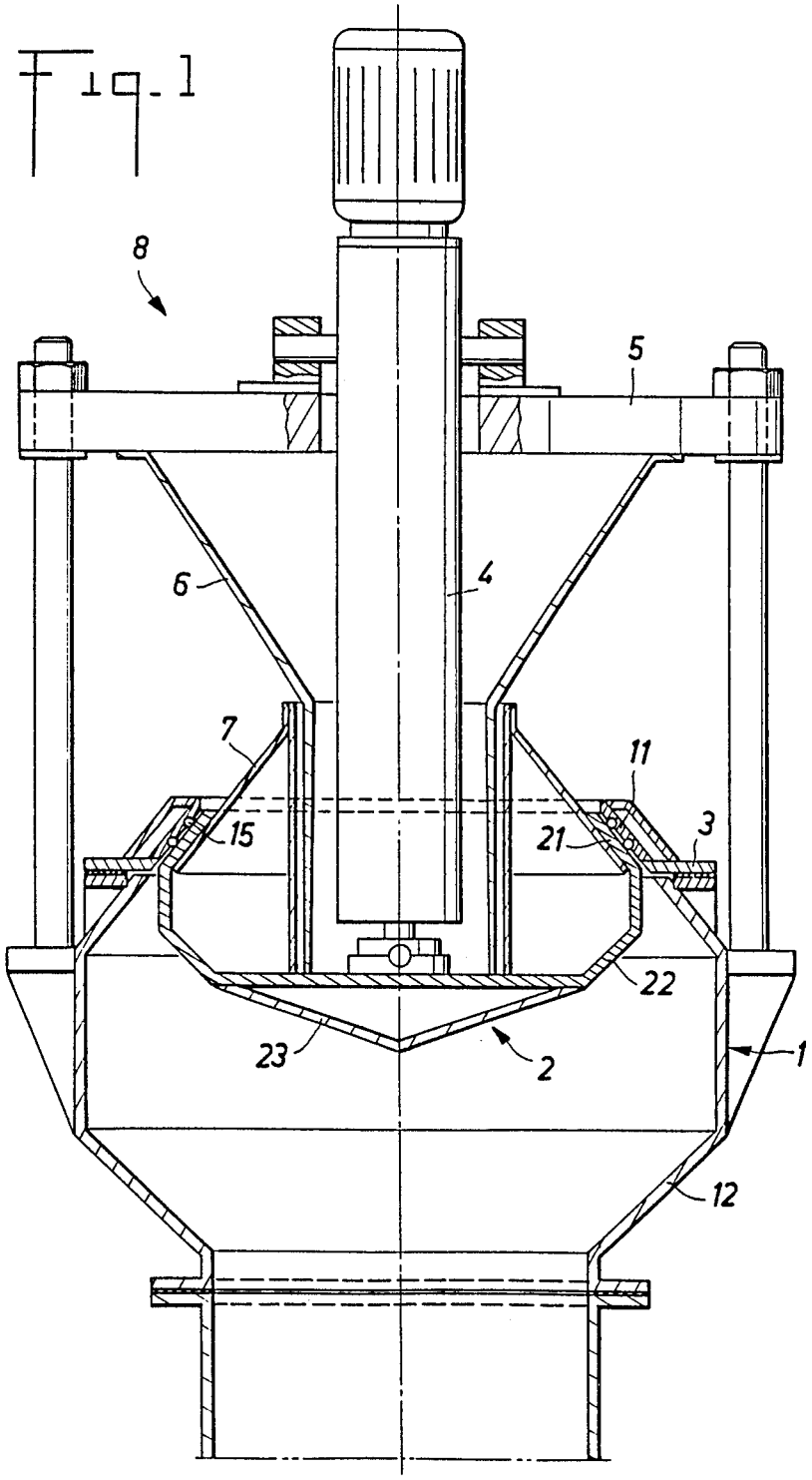
FIG. 1 is a diagrammatical view of an axial section of a valve device according to the invention.

Referring first to FIG. 1, this shows a valve device comprising a biconical valve element 2 with two male truncated parts 21, 22 which are reversed and joined together at the level of their largest diameter, said valve element 2 being movable along the axis of the device between an upper seat 11 and a lower seat 12 of a valve body 1. Seats 11 and 12 are also truncated, their conicity being substantially identical to the conicity of corresponding truncated parts 21, 22 of valve element 2, and they are also joined together by their largest diameter.

Truncated parts 21, 22 of valve 2 are, in the example illustrated in FIG. 1, interconnected by a cylindrical part; similarly, the truncated seats 11, 12 are interconnected by a cylindrical part. The different parts constituting valve element 2 and valve body 1 are so dimensioned and shaped as to ensure an adequate flowing section, opposite the circuit where the device is mounted, between the valve body 1 and the valve element 2 when the latter is in draining position. Said flowing section is preferably at least equal to the surface connecting the valve device on the circuit, so that no limitation of flow can be created inside the body of the device.

Moreover, the shapes of the valve body 1 and of the biconical valve element 2 are so determined as to present the lowest possibilities of pressure losses in order to help the ejection of the gaseous liquid to be removed. To this effect, a conical part 23 joined to the smallest diameter of the truncated part 22 of valve element 2, is advantageously provided at the lower part of said valve element 2, the point of conical part 23 being directed towards the inside of the circuit of fluid.

To enable the positioning or removal of valve element 2, valve body 1 is produced in two parts. The part closest to the circuit where the valve device is mounted is joined to said circuit via connecting means which ensure tightness, such as for example by a flange and joints. Said part is essentially constituted by the lower seat 12 and by the cylindrical part of valve body 1. The second part is constituted by the upper seat 11 which is tightly joined by a flange 3 to the valve body 1, the inner dimensions of which at the level of said flange 3 are such that they allow the passage of valve element 2 during positioning or removal thereof.

The valve device further comprises control means controlling the translation in the axis of the device and the positioning of valve element 2. Said control means are composed of a fixed part joined to the body of valve 1 by a support 8, and by another part which is movable along the axis of the device and which is joined to the valve element 2. Said control means may be of various types and actuated by various types of energy. According to one particular embodiment, a hydroelectric generating set 4 is used, supported by a tripod bracket 5 rigidly secured to the valve body 1.

According to another particularly advantageous embodiment the connections between the control unit 4 and the support 8, on the one hand, and between the control unit 4 and the valve element 2, on the other hand, are articulated and placed in such a way that their articulation axes are orthogonal one to the other and to the axis of the device. This particular disposition gives a certain freedom of movement to the valve with respect to the axis of the device and allows the self-centering thereof on the lower and upper seats 11, 12, thereby improving the contact, hence the tightness, between valve element 2 and seats 11, 12.

In order to guide the flow of gaseous fluid when valve element 2 is in draining or regulated discharge position, and also to protect the control means, diverging skirts 6, 7 are provided on valve element 2 and on the support 8. One of said skirts 7 is secured on valve element 2; the other skirt 6 is secured on the tripod bracket 5, and is so constituted as to slide in skirt 7 secured on valve element 2 when said valve is operated by control means 4. The diverging skirts assembly is produced in such a way that, regardless of the position of valve element 2, there is always one protection wall of said skirts between the control means and the fluid.

It may also be advantageous to produce said skirts so that the space situated inside valve element 2 and said skirts can be ventilated and cooled by forced ventilation means. Such ventilation reinforces the thermal protection of the generating set.

Figure 2:
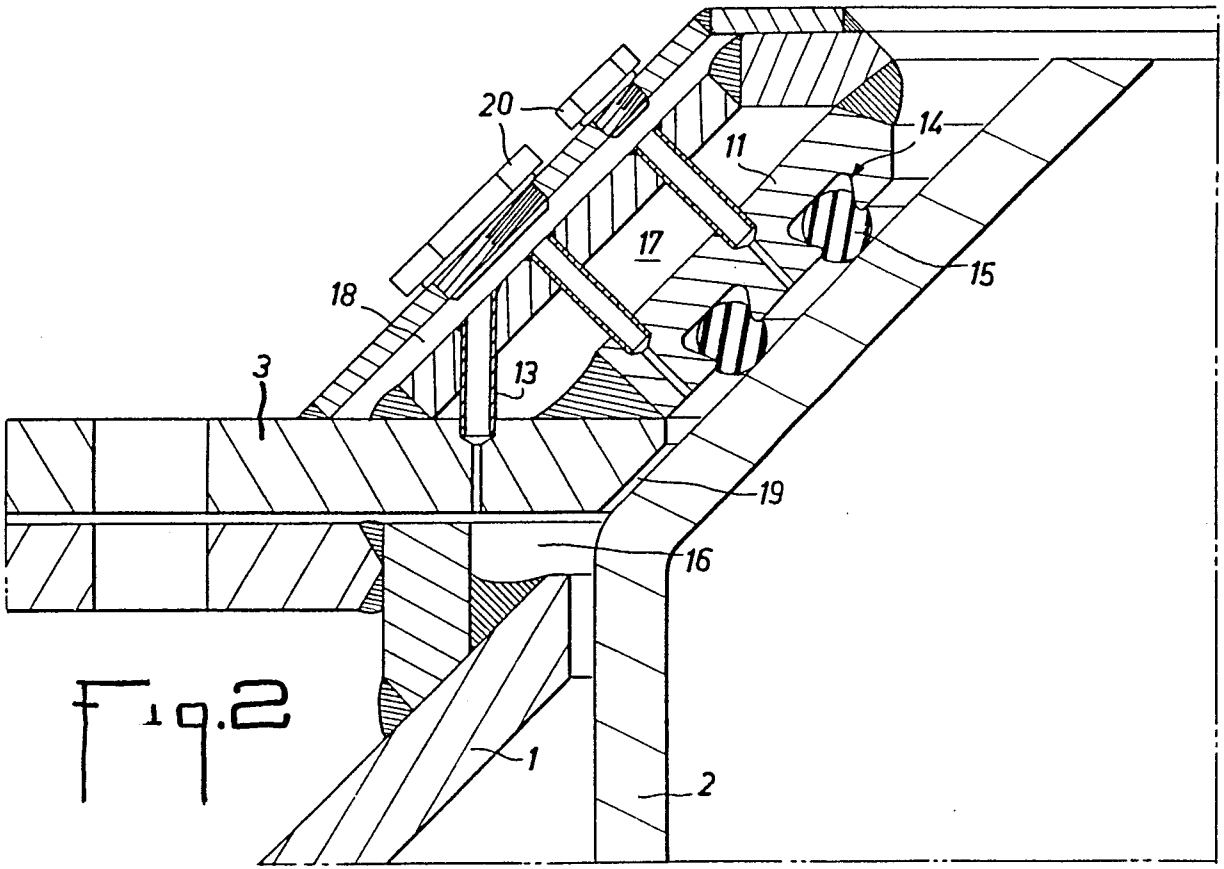
FIG. 2 is a partial axial section of the device showing with more precision the design of the upper seat.
Figure 3A:
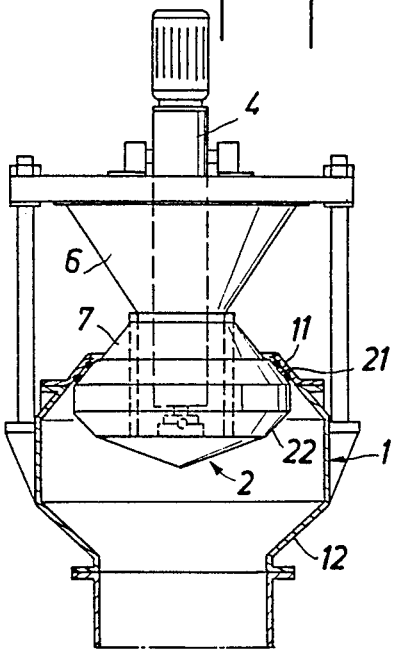
FIG. 3 diagrammatically shows the different functional positions of the valve.
Figure 3B:
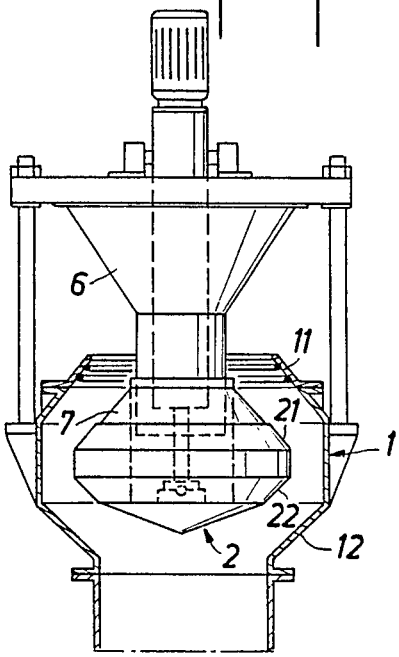
Figure 3C:
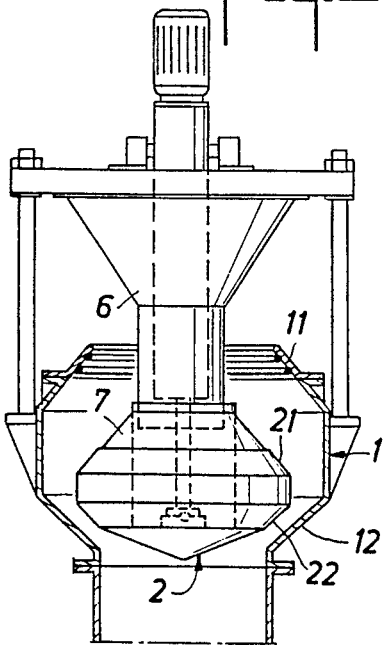
Figure 3D:
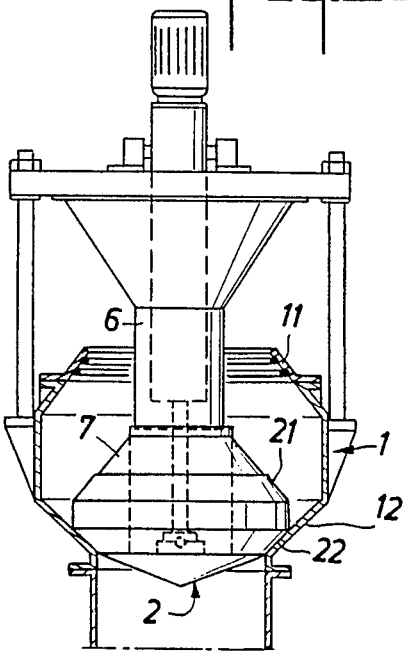

The upper seat 11 may also be provided with protection means to protect those areas of the valve device which are exposed to early deterioration. An embodiment of the upper seat is shown in cross-section in FIG. 2. According to this embodiment, the bearing surface of the upper seat 11 is provided with two seals 15 contained in annular grooves 14 produced in the bearing surface of said upper seat 11. It is also possible to provide in this way one or more seals. The cross-section of annular grooves 14 is such that the seals 15 placed therein are set in position and that said seals 15 project sufficiently from the bearing surface of the upper seat 11 to receive the bearing surface of the truncated part 21 of valve element 2 in the sealing position.

There is also provided at the level of flange 3, a slight inward projection with respect to the bearing surface of the upper seat 11 so as to provide between said projection and the truncated part 21 of valve element 2, a decompression area 19.

To ensure the cooling of the upper seat 11, there is provided on its periphery a cooled annular chamber 17, of which the bearing face of the upper seat 11 constitutes a wall, and inside which a refrigerating fluid can flow.

The upper seat further comprises on the periphery of the cooled chamber 17, another annular chamber called injection chamber 18. Said injection chamber 18 is joined, via small injection nozzles 13, to the bearing surface of the upper seat 11 and to an ejection chamber 16. Said ejection chamber 16 is constituted of an annular recess provided at the level of the inner circumference of the junction plane between the valve body 1 and the flange 3.

Injection nozzles 13 are constituted by sections of tubes traversing in tight manner the cooled chamber 17 and are distributed over the whole periphery of the upper seat 11.

Cleaning plugs 20 are provided, to coincide with the position of the injection nozzles 13, in order to give access to the inside of said nozzles, for cleaning purposes and if necessary for unplugging their orifice issuing on to the bearing surface of the upper seat 11 or into the ejection chamber 16.

The injection means assembly namely injection chamber 18, injection nozzles 13 and ejection chamber 16, is used to blow in an ejecting fluid, such as air, vapor or nitrogen, as soon as the valve moves away from the upper seat.

The blowing-in of ejecting fluid is designed, in combination with the shapes of upper seat 11, to prevent the bearing surfaces from getting soiled and from wearing down through abrasion, and to protect the seals. Indeed, the ejecting fluid will, on the one hand, clear any deposit which may have formed on the bearing surface, and on the other hand create, thanks to the ejection chamber 16, a "layer" of "clen" fluid which prevents the gaseous fluid flowing through the valve device from coming into contact with the bearing surface of the upper seat 11.

It is clear from the foregoing description, that the valve device according to the invention presents many advantages, both by the way it works and by its construction. The dissociation of the insulating and controlled delivery functions is an important factor of long working life and of durable tightness. The seals may be replaced in totally safe conditions when the valve is in the safety position. Such an intervention is possible, even if the circuit is under pressure, due to the possibility of constituting a water joint, by adequately wedging the valve.

The simple construction of the valve device, with readily dismountable modular elements makes it easy and inexpensive to produce and to mount. Moreover, its overall dimensions perpendicularly to the axis of the device can virtually be reduced to the circumference of the valve body, without any elements projecting from said circumference.

Adaptation of the various control means is particularly simple, so is the adaptation of the device to different applications depending on the characteristics of the fluid circuit. In particular, the materials which constitute the body 1, the biconical valve element 2, the insulating upper seat 11, and the skirts 6,7 can be of different nature, such as mechanical-welded steel, cast steel, alloys, composite or other materials. The cooling of the valve element and of the upper seat as well as the protection by ejecting fluid can be adapted to different uses by any one skilled in the art without departing from the scope of the invention.

The valve device finds numerous applications in all the industries using gaseous fluid circuits such as supply systems of gas, steam, etc.

Said device finds a particular application in the iron and steel industry, for venting blast-furnace throats, during programmed interruptions.

What is claimed is:

1. A valve device for the sealing, draining or regulated discharging of a gaseous fluid circuit comprising:

(a) a valve body provided with opposed first and second sealing seats;

(b) a valve element disposed inside the valve body for movement along an axis of the device, the valve element being provided with opposed first and second bearing surfaces;

(c) the first and second sealing seats being, respectively, engagable by the first and second bearing surfaces for tightly separating a zone situated downstream of the device from a zone situated upstream of the device;

(d) control means, including a control unit and a support, for moving the valve element along the axis of the device to a predetermined position and maintaining the valve element in such position;

(e) the control unit including a first part joined to the valve body by the support, and a second part movable along the axis of the device, the second part being joined to the valve element; and (f) the connection between the control unit and the support, and the connection between the control unit and the valve element being articulated and so disposed that their articulation axes are orthogonal one with respect to the other, and with respect to the axis of the device.

2. The device of claim 1 further including a tripod bracket rigidly fixed to the valve body, and the control unit includes a hydroelectric generating set supported by the tripod bracket.

3. The device of claim 1 further including:

(a) first and second diverging skirts for guiding the flow of gaseous fluid when the valve element is disposed in a draining or regulated discharging position to protect the control means;

(b) the first diverging skirt being fixed to the support and the second diverging skirt being fixed to the valve element; and (c) the diverging skirts being slidable one into the other during translation of the valve element.

4. The device of claim 1 wherein the first sealing is disposed on the side of the device furthermost from the circuit, the second sealing is disposed on the side of the device closest to the circuit, and the second bearing surface of the valve element being engageable on the second sealing seat for isolating the circuit from the first sealing seat.

5. The device of claim 1 further including a flange tightly joining the first sealing seat to the valve body, the inner dimensions of the first seat at the level of the flange being such as to permit the passage of the valve element when the first seat is either mounted in the device or removed therefrom.

6. The device of claim 5 wherein the first sealing seat includes a first annular chamber on its periphery for circulating a cooling fluid therethrough, means for flowing in a protective fluid, the flowing means being distributed on the circumference of the first sealing seat and includes a second annular chamber disposed on the periphery of the first annular chamber, the second annular chamber being connected by a plurality of injection nozzles to the surface of the first sealing seat engageable by the first bearing surface and to an ejection chamber defined by an annular recess provided at the level of the inner circumference of the joining plane between the valve body and the flange.

7. The valve device of claim 1 wherein the valve element includes two male parts of truncated configuration, the male parts being reversed and joined together at their largest diameter, the male parts defining the first and second bearing surfaces, and a conical part joined to the smaller diameter of the second male part.

8. The valve device of claim 1 with the control means disposing either the first bearing surface in engagement on the first sealing seat for sealing the device or positioning the second bearing surface at a predetermined distance with respect to the second sealing seat so that the distance between the second bearing surface and second sealing seat regulates discharging of gas flow out of the circuit.

9. A valve device for sealing, draining and regulated discharging of a gaseous fluid circuit, comprising:

(a) a valve body provided with a opposed first and second sealing seats;

(b) a valve element disposed inside the valve body for movement along an axis of the device, the valve element being provided with opposed first and second bearing surfaces and including two male parts of truncated configuration, the male parts being reversed and joined together at their largest diameter, the male parts defining the first and second bearing surfaces, and a conical part joined to the smaller diameter of the second male part;

(c) the first and second sealing seats being, respectively, engagable by the first and second bearing surfaces for tightly separating a zone situated downstream of the device from a zone situated upstream of the device;

(d) control means for moving the valve element to a predetermined position and maintaining the valve element in such position, the control means disposing either the first bearing surface in engagement on the first sealing seat for sealing the device or positioning the second bearing surface at a predetermined position with respect to the second sealing seat so that the distance between the second bearing surface and second sealing seat regulates discharging of gas flow out of the circuit; and (e) a support, the control means including first and second parts, the first part being joined to the valve body by the support, the second part being movable along the axis of the device and joined to the valve element, and wherein the connection of the valve element with the control means and the connection of the valve element with the support being articulated and so disposed that their articulation axis are orthogonal one with respect to the other, and with respect to the axis of the device.

10. The device of claim 9 further including a tripod bracket rigidly fixed to the valve body, and the control means includes a hydroelectric generating set supported by the tripod bracket.

11. The device of claim 9 further including first and second diverging skirts for guiding the flow of gaseous fluid when the valve element is in a draining or regulated discharging position and for protecting the control means, the first and second skirts being fixed, respectively, on the support and on the valve element and being slidable one into the other during the displacement of the valve element.

12. The device of claim 11 further including forced ventilation means disposed within the diverging skirts.

* * * * *